US009011277B2

(12) United States Patent
Schell

(10) Patent No.: US 9,011,277 B2
(45) Date of Patent: Apr. 21, 2015

(54) BALL-STRIKING TRAINING APPARATUS

(76) Inventor: Dominic Schell, Plano, TX (US)

( * ) Notice: Subject to any disclaimer, the term of this patent is extended or adjusted under 35 U.S.C. 154(b) by 0 days.

(21) Appl. No.: 13/593,269

(22) Filed: Aug. 23, 2012

(65) Prior Publication Data

US 2014/0057742 A1 Feb. 27, 2014

(51) Int. Cl.

| | |
|---|---|
| ***A63B 69/00*** | (2006.01) |
| *A63B 71/02* | (2006.01) |
| *A63B 69/38* | (2006.01) |

(52) U.S. Cl.

CPC ..... *A63B 69/0002* (2013.01); *A63B 69/002* (2013.01); *A63B 2069/0008* (2013.01); *A63B 2225/093* (2013.01); *A63B 2071/026* (2013.01); *A63B 69/0079* (2013.01); *A63B 69/38* (2013.01)

(58) Field of Classification Search

CPC .. A63B 69/0091; A63B 69/002; A63B 69/00; A63B 2243/0025; A63B 2243/0004

USPC ..... 473/422, 423, 429, 430, 454, 446, 438

See application file for complete search history.

(56) References Cited

U.S. PATENT DOCUMENTS

| | | | | | |
|---|---|---|---|---|---|
| 1,862,044 | A | * | 6/1932 | White | 473/429 |
| 2,011,184 | A | | 8/1935 | Peters | |
| 2,976,040 | A | * | 3/1961 | Bales | 473/429 |
| 3,118,670 | A | * | 1/1964 | Smith | 473/429 |
| 3,186,711 | A | * | 6/1965 | Morrow | 473/575 |
| 3,454,275 | A | | 7/1969 | Pontone | |
| 3,498,613 | A | | 3/1970 | Dreyer | |
| 3,851,886 | A | * | 12/1974 | Acosta | 473/139 |
| 4,105,203 | A | * | 8/1978 | Cho | 473/429 |
| 4,278,257 | A | * | 7/1981 | Garcia et al. | 473/423 |
| 4,462,599 | A | | 7/1984 | Brown | |
| 4,576,379 | A | | 3/1986 | Juhasz | |
| 4,616,834 | A | * | 10/1986 | Davis | 473/429 |
| 5,060,946 | A | | 10/1991 | Taylor | |
| 5,246,226 | A | * | 9/1993 | McGuinn | 473/429 |
| 5,271,618 | A | * | 12/1993 | Malwitz | 473/429 |
| 5,303,914 | A | * | 4/1994 | Cooksey | 473/429 |
| 5,454,561 | A | | 10/1995 | Smith | |
| 5,472,186 | A | * | 12/1995 | Paulsen | 473/429 |
| 5,480,141 | A | * | 1/1996 | Wood | 473/429 |
| 5,957,789 | A | | 9/1999 | Ainscough et al. | |
| 6,086,488 | A | * | 7/2000 | Sanders | 473/423 |
| 6,685,146 | B1 | * | 2/2004 | Sanchez, Jr. | 473/417 |
| 7,811,183 | B1 | * | 10/2010 | Ohle | 473/429 |
| 8,083,618 | B2 | * | 12/2011 | Coscarelli et al. | 473/429 |
| 2003/0224880 | A1 | | 12/2003 | Hansberry | |
| 2005/0113193 | A1 | | 5/2005 | Wardle et al. | |
| 2010/0130312 | A1 | * | 5/2010 | Fuentes | 473/429 |
| 2011/0021295 | A1 | | 1/2011 | Coscarelli et al. | |

* cited by examiner

*Primary Examiner* — Mitra Aryanpour
(74) *Attorney, Agent, or Firm* — Jack D. Stone, Jr.; Scheef & Stone, L.L.P.

(57) ABSTRACT

An apparatus for an athlete to train or practice ball-striking techniques. The apparatus comprises a base, a stand, an arm, and a bearing assembly connected to a tethered ball via a rope. The athlete may strike or volley the ball in order to produce a substantially circular orbit about the bearing assembly, indicating proper form and technique. If the athlete strikes the ball with improper form or technique, the ball may orbit the bearing assembly in a substantially non-circular orbit, such as an oval. The ball may be any suitable ball from a number of sports where correct form and technique for striking or volleying a ball is desired. By way of example, the ball may be preferably a soccer ball, a volley ball, a baseball, among others.

20 Claims, 7 Drawing Sheets

BALL-STRIKING TRAINING APPARATUS

TECHNICAL FIELD OF INVENTION

The invention relates generally to an apparatus for an athlete to train or practice his or her technique to properly strike or volley a ball, with the ball exhibiting a circular orbit when struck correctly and a non-circular orbit when struck incorrectly.

BACKGROUND OF THE INVENTION

In many sports, an important and fundamental skill acquired by athletes is the striking of a ball, such as the kicking of a soccer ball, the volleying of a volley ball, or the hitting of a baseball with a wooden or metallic bat. In these sports, young aspiring athletes are typically trained to develop effective techniques for striking the ball in their respective sports. In many instances, the athlete must be instructed by a coach who teaches and develops proper ball-striking techniques. However, many times the typical athlete is never taught the correct fundamentals of how to strike the ball properly, or the training is meager at best. Thus, many athletes expend a significant amount of time developing the proper skills to developing these ball-striking techniques, delaying or stunting development with regard to more advanced techniques. This may result in athletes being unable to truly reach their true potential in a given sport.

For instance, in soccer, the fundamentals for correctly kicking a soccer ball involve proper foot placement for both the plant foot as well as the kicking foot. This is particularly important when the soccer ball is not simply resting on the ground, but is in mid-air, as may commonly be the case during a typical soccer match. The amount of force, as well as the angle of attack on the ball are also primary considerations in the proper striking of the ball, particularly of a ball in mid-flight. Generally speaking, proper technique for kicking a soccer ball requires that the non-kicking "plant" foot needs to be next to the ball at the point of the kick. The ball joint of the plant foot is typically in line with the middle of the soccer ball, approximately three to six inches away. The plant leg is bent to a 45 degree angle about the knees, and the kicking foot is pointed straight out away from the body.

Many times, young athletes are not taught the proper techniques for kicking a soccer ball. For example, the plant foot may be placed at an incorrect distance from the ball, or the striking angle is consistently off center. Thus, the athlete may develop poor technique or tendencies which may hamper further development and require a substantial amount of time to correct. In many cases, the athlete may simply continue kicking the ball incorrectly, as there may be no one to provide proper instruction or guidance on how to properly kick the ball.

In other instances, a coach or trainer will provide instruction and guidance to the athlete as to the proper technique for kicking the soccer ball. However, this requires the active involvement of another individual who may be responsible for training several other athletes at the same time. Therefore, the athlete may not be able to obtain personalized training with the coach or trainer for an extended duration, and the athlete is left to train on an individual basis. In addition, athletes typically run into a set of other problems should they wish to train by themselves. For example, an athlete that simply wishes to practice his or her kicking technique may kick the ball, and then have to retrieve the ball immediately after kicking in order to kick the ball again. This is extremely time consuming if many repetitions are desired, as is normally the case for improving kicking technique. An athlete may reduce the time spent retrieving the ball by having a large number of practice soccer balls readily available. However, this solution is financially untenable for most individuals and does not address the problem of eventual ball retrieval.

An athlete may also choose to practice with another athlete, thereby cutting down on the ball retrieval aspect and may cooperatively train at a fast rate. However, many times an athlete may wish to train on an individual basis, or a partner is not conveniently available at the time the athlete wishes to train. Further, these training solutions do not allow the athlete to practice indoors, such as the living room of a home when the inclement weather forces cancellation of outdoor activities, or it is simply too dark to practice outside. As a result, while the athlete receiving guidance from an coach or trainer may benefit more than an athlete without such resources, the athlete receiving guidance may still not be developing proper kicking techniques to their maximum potential. Many of these deficiencies are also present in other sports where ball-striking techniques are critically important, and thus a solution to these deficiencies would potentially be applicable in these other sports.

Furthermore, while apparatuses for ball-striking training have been previously introduced, they have lacked the capability to allow an athlete to self-train in a controlled, repeatable fashion wherein the ball will rotate in a controlled, circular orbit when struck correctly yet rotate in a non-circular orbit when struck incorrectly, thereby providing immediate feedback to the athlete as to the athlete's ball-striking technique. What is therefore needed in the field of ball-striking training is a portable training apparatus that allows an athlete to properly train the kicking of a soccer ball in mid-flight on an individual basis and provides immediate feedback as to whether the athlete is practicing proper kicking technique in striking the soccer ball.

SUMMARY OF THE INVENTION

The present invention addresses these problems by providing a portable, relatively inexpensive, easy-to-setup-and-utilize ball-striking training apparatus that allows for an athlete to practice ball-striking techniques at any convenient time and location. The ball-striking training apparatus may be easily setup at any location, indoor or outdoor, and be utilized by an individual athlete to proper practice ball-striking techniques without the need for a coach or trainer to supervise the training process, as the training apparatus may provide immediate feedback to the athlete as to whether or not proper technique has been used.

The training apparatus generally comprises a base for securing the apparatus to an outdoor or indoor location with a vertically adjustable stand mounted to the base. The base may be provided with mounting holes located along the perimeter of the base to facilitate the use of reusable stakes for securing the base to the ground, such as a grassy playing surface. In other embodiments, the base may be a weighted body for use of the training apparatus indoors. An end of the stand opposite the base may be connected to an elbow section which provides a bend of approximately 90 degrees. The stand itself may be height-adjustable through the use of an inner stand section nested within an outer stand section, the nested sections slidingly positioned at a desired height and having a series of pin holes secured by through-pins. An arm may be attached at an end of the elbow section opposite the stand using similar through-pins and holes as with the connection between the elbow and stand. In other embodiments of the invention, the elbow section may provide for additional arms to be attached, to allow for more than one athlete to train on the apparatus at the same time. A rotating bearing assembly is mounted on an opposite end of the arm and provides a tether connector for attaching a first end of a rope of a predetermined length. The rope may be made of an elastic or non-elastic material. An opposite end of the rope is connected or otherwise tethered to a ball, such as a soccer ball.

When kicked, the kinetic forces upon the tethered ball will cause the ball to follow an orbital path around the arm due to the use of the rotating bearing assembly. If the athlete kicks the ball at an optimum angle, the ball will rotate about the arm in a near circular motion. However, if the kick is not optimum, the ball may rotate in a more elongated, oblong fashion; resulting in a more oval orbit. In this fashion, the athlete may immediately see the results of the kick, and practice and adjust his or her kicking technique accordingly until the athlete's kick results in a consistent kicking motion that creates a circular orbit every time.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation.

Figure 1:
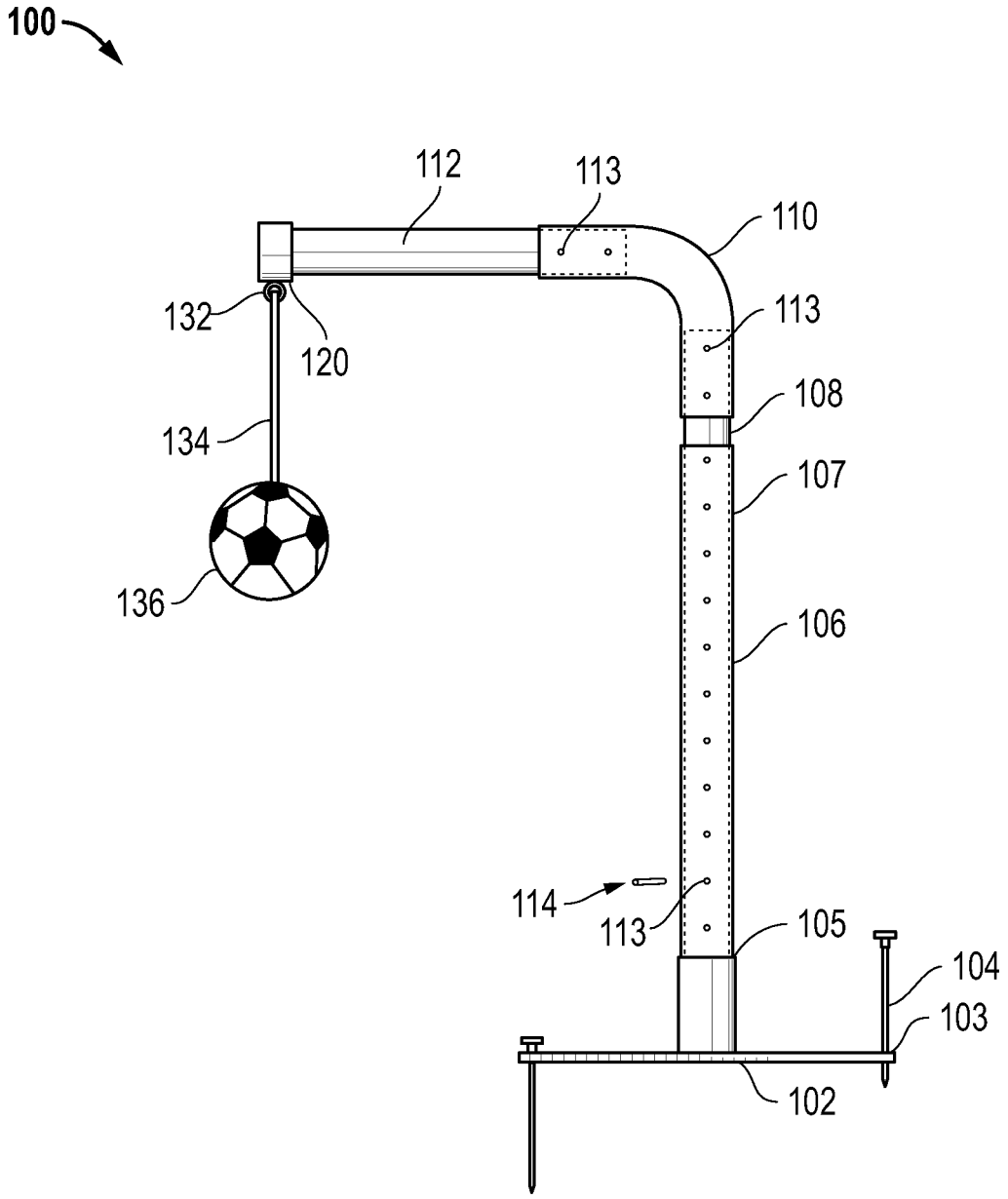
FIG. 1 is a frontal elevation view of an exemplary embodiment of the ball-striking training apparatus.

Referring to FIG. 1, therein is shown a side view of a ball-striking training apparatus 100. Apparatus 100 has a base 102 preferably constructed of a durable, weather-resistant material such as a metallic alloy, rubber or hard plastic. The base 102 is preferably shaped and sized to provide a stable support structure for the apparatus 100, and is preferably of a sufficient length and width to accommodate the remaining parts of the apparatus 100. The base 102 is preferably circular or substantially square-shaped. In a preferred embodiment of the apparatus 100, the base comprises a square shape and measures approximately 24 inches in length and width. The base 102 is preferably placed on an outdoor surface (not shown) such as an ordinary grass field, sod turf or some other playing surface. The base 102 preferably defines a plurality of mounting holes 103 located adjacent the edges of the base 102 to accommodate stakes 104. The mounting holes 103 are preferably shaped and sized to provide a secure connection between the base 102 and stakes 104, as well as to allow for the stakes 104 to be removed at a later time if desired. The stakes 104 are preferably constructed of a durable material such as metal, or hard plastic, and be of a sufficient length such that the base 102 is securely fastened to the soiled turf when the stakes are driven through the mounting holes 103.

In other embodiments of the invention, rather than providing mounting holes 103, the base 102 is preferably constructed to be weighted down with a material such as sand or water. In this manner, the apparatus 100 may be used in an indoor location such as a house or a gymnasium where it is impossible or impracticable to use stakes 104. The base 102 has a centrally located stand mount 105 operable to mount a stand 106. The stand mount 105 preferably comprises an upright column extending from base 102 and having a cavity dimensioned to receive a lower end of stand 106. Depending on the particular shape of stand 106, stand mount 105 is preferably circular, square, rectilinear in shape or is preferably some other shape suitable for securely receiving the lower end of stand 106.

The stand 106 preferably comprises a durable metal column for supporting the various sections of the apparatus 100 as well as to adjust and extend the height of the apparatus 100. In various embodiments of the apparatus 100, the stand 106 preferably comprises a column that is rectilinear, or cylindrical in shape. In the embodiment illustrated in FIG. 1, the stand 106 is cylindrical or tubular in shape. The stand 106 preferably has a hollow interior cavity extending the length of the stand 105 in order to reduce the weight and manufacturing costs of apparatus 100. As mentioned previously, the stand 106 is mounted to the base 102 via the stand mount 105, and is preferably mounted by simply inserting an end of the stand 106 into a cavity of the stand mount 105. This facilitates a stable and secure connection between the base 102 and the stand 106, yet allows for easy assembly and disassembly of the stand 106. In a preferred embodiment of the apparatus 100, the stand 106 preferably comprises two nested stand sections, namely an outer stand section 107 and an inner stand section 108, with the inner stand section 108 nested within the outer stand section 107. As such, the inner stand section 108 has a slightly smaller cross-sectional area than the outer stand section 107 in order to allow for the nesting of the two sections. Furthermore, both stand sections 107 and 108 retain the hollow interior cavity of stand 106 in order to maintain the reduced weight and cost features of the stand 106. Another function for the nesting of the stand sections 107 and 108 is to allow for the inner stand section 108 to slide relative to the outer stand section 107, which is securely engaged with the stand mount 105. The sliding of the inner stand section 108 relative to the outer stand section 107 allows for the height adjustment of the apparatus 100. This is preferably accomplished by an individual setting up the apparatus 100.

Once a desired height is obtained, the inner stand section 108 is secured to the outer stand section 107 through the use of a series of pin holes 113 and through-pins 114. The pin holes 113 are preferably incrementally provided along a side of the outer stand section 107 with each equidistant pin hole 113 providing for a different desired height. The inner stand section 108 preferably contains corresponding pin holes 113, albeit with the pin holes 113 provided at the upper and lower ends of the inner stand section 108 only. When the pin holes 113 of the outer section 107 and lower end of the inner section 108 are aligned, a through-pin 114 is preferably inserted into the aligned pin holes 113 to secure the height adjusted stand 106 in a desired position. The height of stand 106 is preferably secured by the use of a single through-pin 114, or additional through-pins 114 may be used depending on the particular configuration of the apparatus 100.

An elbow 110 is preferably securely attached to the top of the stand 106, and more specifically by fitting the elbow 110 over the upper end of the inner stand section 108. The elbow 110 is essentially an extension of stand 106 that provides a bend of approximately 90 degrees about the center of the elbow 110 to facilitate the connection of an arm 112 to the stand 106. The elbow 110 is preferably constructed in similar fashion to the stand 106, and is preferably made of the same material and having a hollow interior cavity. The elbow 110 preferably also has a rectilinear, cylindrical or other shape depending on the shape of stand 106. In the embodiment of apparatus 100 shown in FIG. 1, the elbow 110 is tubular in construction. As with the interior stand section 108, the elbow 110 preferably includes one or more equidistant pin holes 113 on the ends of the elbow 110 to facilitate secure connections to either the stand 106 or to the arm 112. Because the approximately 90 degree bend of the elbow 110 is located about the center of the elbow, the ends of the elbow are alternatively used for connection to either the stand 106 or the arm 112. Furthermore, the elbow 110 preferably shares the same cross-sectional dimension as outer stand section 107. In this manner, the elbow 110 allows for the upper end of inner stand section 108 to be inserted into an end of the elbow 110. The through-pins 114 are then preferably inserted to secure the connection between the elbow 110 and the stand 106.

An arm 112 is preferably securely connected to an end of the elbow 110 opposite the stand 106. The arm 112 may be similar in construction with the elbow 110 and stand 106 in that the arm 112 preferably uses the same materials as the elbow 110 and the stand 106, as well as sharing the same hollow interior cavity. In FIG. 1, the arm 112 is tubular in construction and shares the same diameter as the inner stand section 108. That is, the arm 112 is preferably configured to have the same cross-sectional dimension as the inner stand section 108. In this way, a first end of arm 112 is preferably inserted into the free end of the elbow 110. The first end of the arm 112 additionally has one or more pin holes 113 that are preferably equidistant from one another so as to allow for alignment with the one or more of the pin holes on the free end of the elbow 110. The purpose of the arm 112 is to provide for a substantially horizontal extension to the apparatus 100 in order to allow ample room for an athlete to train on the apparatus as well as to provide a stable mount for the bearing assembly upon which a practice ball is tethered. Therefore, the arm 112 should be of a sufficient length to allow for an athlete to training volleying techniques without accidentally contacting or striking the stand 106. Simultaneously, the length of the arm 112 should be controlled such that the bearing assembly will not swing wildly about when the ball is struck or volleyed. Increasing the length of the arm 112 will result in less rigidity of the apparatus 100, and induce greater flex in the arm 112 when the ball is volleyed or struck. Thus, an intermediate length which accomplishes these two objectives is desired for the arm 112.

A bearing assembly 120 is located at a second end of the arm 112. The bearing assembly 120 preferably comprises an inner bearing race as well as an outer bearing race with bearings located therebetween to allow for the smooth rotation of the outer race relative to the inner race and the arm 112. The bearing assembly 120 is preferably fixedly attached to the second end of the arm 112, and is preferably constructed of cylindrical bearings, such as those manufactured by McGill Manufacturing Co., Inc., of Valparaiso, Ind. Cylindrical bearings, also known as roller bearings, are preferred for their increased strength and durability over more traditional ball bearings for the bearings used between the bearing races. Other types of bearings contemplated within the scope of the present invention preferably include cam follower bearings; track roller wire straightener and guide bearings; caged and center-guided roller bearings; spherical roller bearings; and aircraft bearings. During use of the apparatus 100, it has been found that traditional spherical bearing assemblies may become stressed during continuous repetitions of an athlete's practice volleys such that the bearing assembly may become worn, rendering the apparatus 100 unusable. Thus, cylindrical bearings, which have a much greater point of contact to the bearing races, are substantially more suitable for use in apparatus 100.

A tether connector 132 is provided on a side of the bearing assembly 120 and is preferably shaped and sized to allow for the connection of a rope 134. The tether connector 132 is preferably a ring shaped article or some other suitable shape for fixedly securing an end of the rope 134. The rope 134 is preferably made of an elastic material or may be inelastic. A first end of the rope 134 is then connected to the bearing assembly 120 via the tether connector 132. A second end of the rope 134 is connected to a ball 136 for the athlete to practice. The ball 136 is preferably any type of ball used in sports where striking or volleying the ball is a fundamental aspect of the sport, and is preferably a soccer ball, volley ball, baseball among others. In the embodiment shown in FIG. 1, the ball 136 is a soccer ball.

Figure 2:
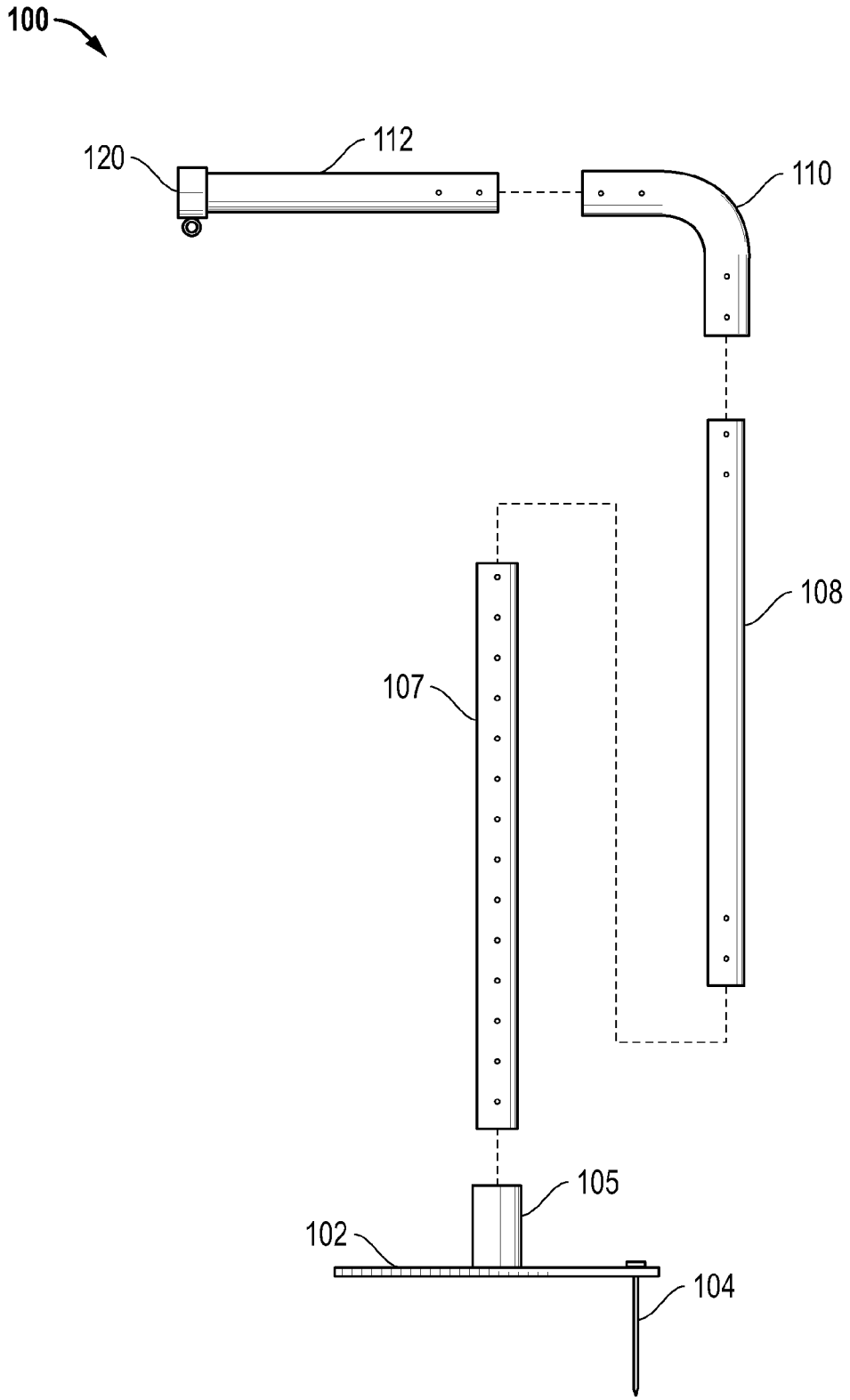
FIG. 2 is a view of the various components constituting the ball-striking training apparatus of FIG. 1.

Turning next to FIG. 2, an exploded view of the apparatus 100 is shown. As can be seen in FIG. 2, the individual sections of the apparatus 100 may be easily assembled without the use of any particular tools or equipment, and can likewise be quickly broken down for transport and storage. For example, and as described in FIG. 1, the base 102 is preferably mounted to a grassy playing surface through the use of the stakes 104 which can simply be pushed into the ground using a hand or foot. The stakes 104 are preferably removed by simply pulling up on the stakes 104. The stand 106 comprises an outer stand section 107 and an inner stand section 108 with the inner section 108 nested within the outer section 107. The stand 106 is preferably slotted into the stand mount 105 of the base 102. The elbow 110 is preferably fitted atop the stand 106, and in particular to the inner stand section 108. A set of through-pins 114 are preferably inserted by hand into the aligned pin holes 113 present at the end of inner stand section 108 and an end of elbow 110. The arm 112 with attached bearing assembly 120 is likewise mounted to the free end of the elbow 110 via the same system of pin holes 113 and through-pins 114. A ball 136 is tethered to a rope 134, and the free end of the rope 134 is connected to the bearing assembly 120 via a tether connector 132 located on the outer surface of bearing assembly 120. The rope 134 is preferably connected to the tether connector by hand as well. Thus, it can be seen that the apparatus 100 is preferably conveniently assembled and disassembled with a minimal amount of effort and without the use any particular tools.

Figure 3:
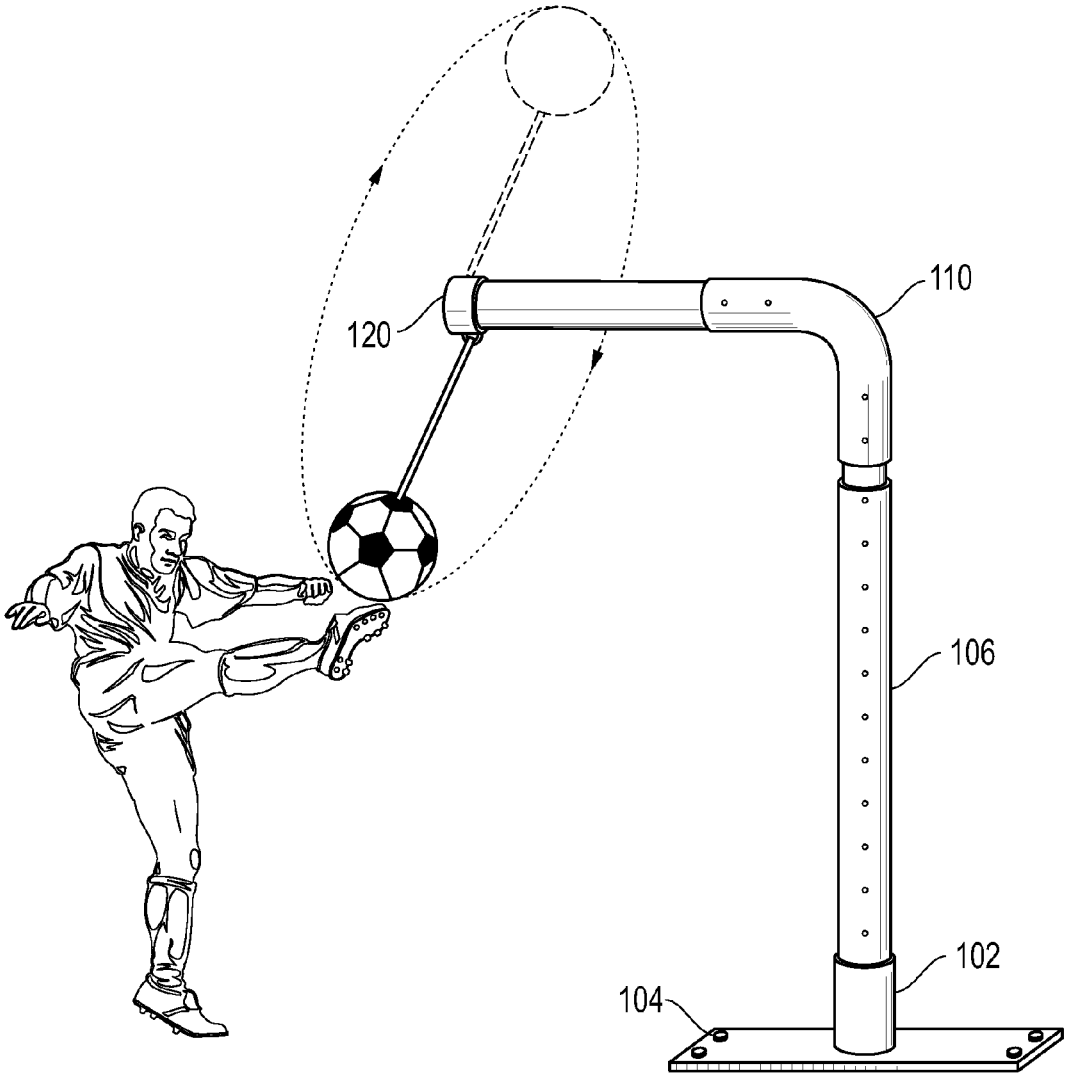
FIG. 3 is a frontal elevation view of the ball-striking training apparatus of FIG. 1, illustrating where a ball has been incorrectly struck.

Next, at FIG. 3, an illustration of the apparatus 100 with the ball 136 being struck in an incorrect manner is shown. During use of the apparatus 100, an athlete strikes the ball 136 with the preferred striking instrument, be it a hand, foot, arm, leg or some other device such as a bat or club. As the ball 136 is struck, it will freely rotate around the arm 112 and specifically the bearing assembly 120. When the ball has been struck incorrectly, it will rotate about the bearing assembly 120 in an elongated, oblong orbit. That is, the motion of the ball 136 orbiting about the bearing assembly 120 will take on the shape of an oval. Thus, an athlete practicing on the apparatus 100 will be able to immediately determine whether or not the proper technique has been used in striking the ball 136, whether it be a strike with an arm, a kick with a leg, or a hit with some other instrument. The athlete may then adjust the manner for striking the ball, and through repetition, eventually learn to strike the ball 136 in a correct manner.

Figure 4:
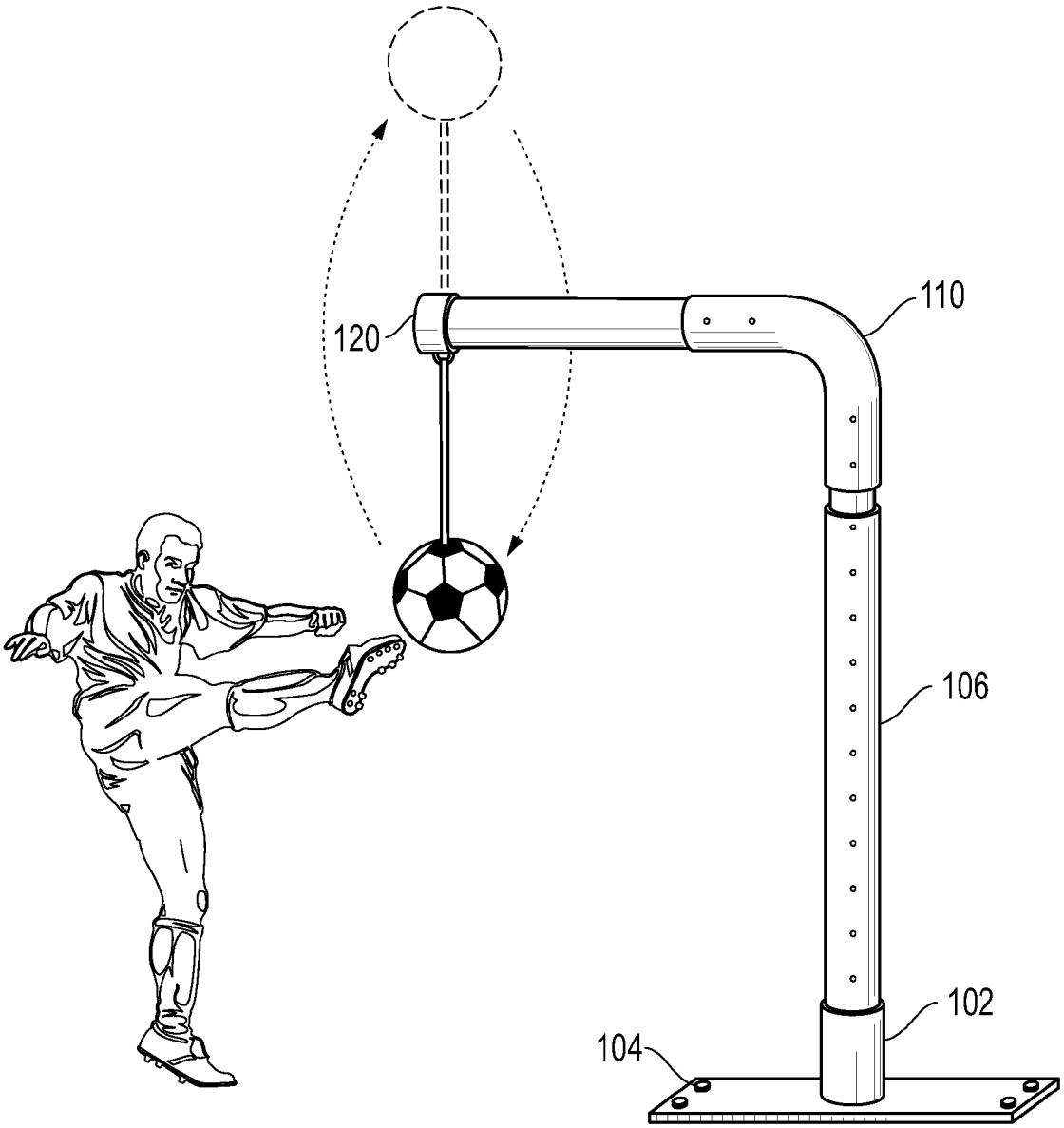
FIG. 4 is a frontal elevation view of the ball-striking training apparatus of FIG. 1, illustrating where the ball has been correctly struck.

At FIG. 4, therein is shown an illustration of the apparatus 100 with the ball 136 being struck in the correct manner. When the ball 136 has been struck correctly, it will rotate in a substantially circular orbit. That is, the motion of the ball 136 orbiting about the bearing assembly 120 will take on the shape of a circle. The orbit of the ball may be in a substantially vertical plane, or may substantially deviate from normal. So long as the shape of the orbit is circular in shape, the ball has been struck in a correct manner. The circular orbit of the ball provides immediate feedback to the athlete that his/her striking technique is proper, and the athlete may continue repetitions of the striking technique to ensure proper performance during competition. Thus, apparatus 100 provides for a simple, yet highly effective training tool for athletes across a wide variety of sports to self-practice the proper ball-striking techniques of their individual sport without the need for a training partner or coach to supervise the training process.

Figure 5:
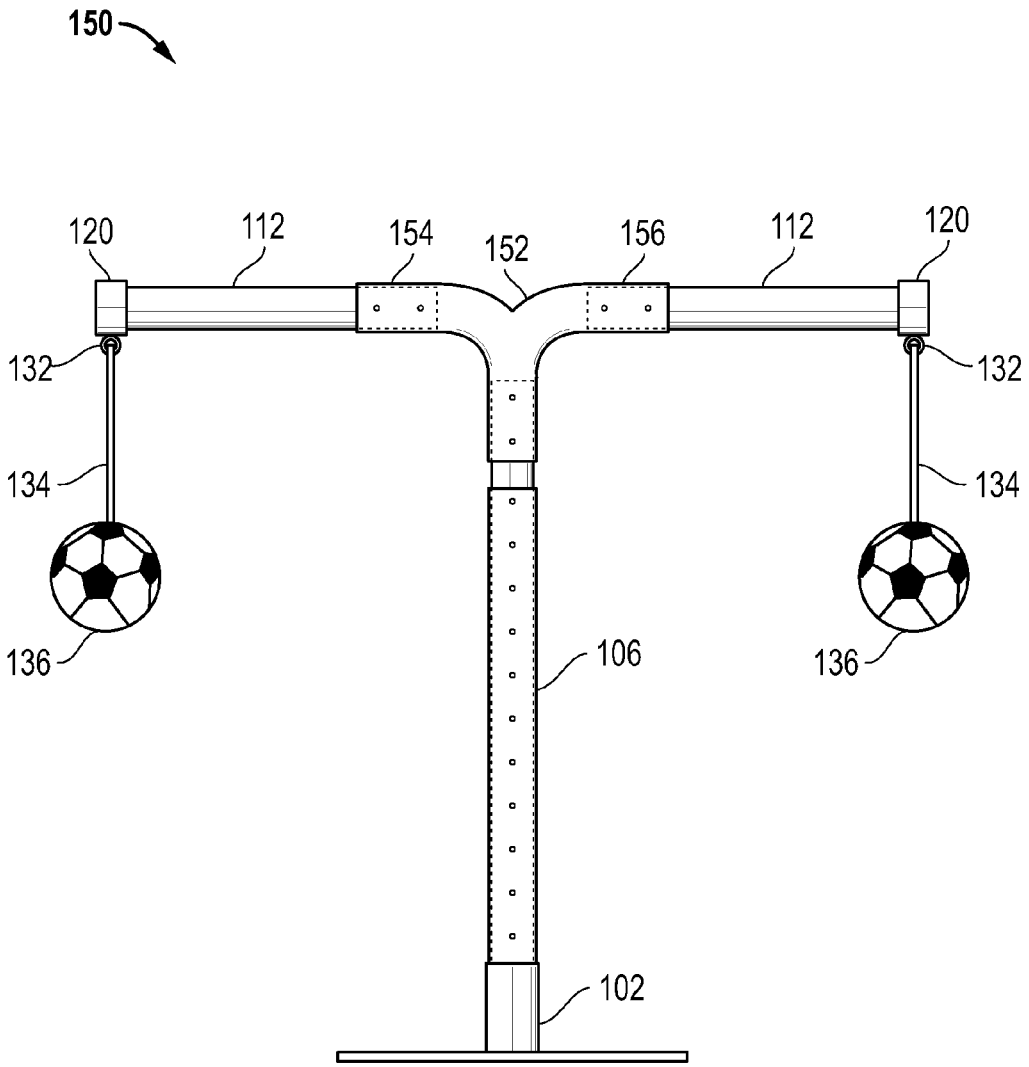
FIG. 5 is a frontal elevation view of the ball-striking training apparatus of FIG. 1, with dual arms for two athletes to train simultaneously.

Next, at FIG. 5 another embodiment of the present invention is shown. In the embodiment disclosed in FIG. 5, an apparatus 150 comprises many of the same fundamental components as apparatus 100. However, in the embodiment shown in FIG. 5, the apparatus 150 has an elbow 152 that provides for two separate arms 112 to be inserted. The elbow 152 has two opposing arm sockets 154 and 156 which terminate on either side of the elbow 152. Thus, the apparatus 150 preferably supports two arms 112, each with an attached bearing assembly 120, as well as two ropes 134 and two practice balls 136 as shown and configured. The apparatus 150 otherwise makes use of the same stand 106 and base 102. Thus, the apparatus 150 preferably allows for two athletes to train and practice ball-striking technique while also cutting down on the time it would take to setup two apparatuses 100. Additionally, the apparatus 150 allows for two different types of balls 136 from different sports to be used simultaneously, such as a soccer ball and a volleyball. The apparatus 150 further illustrates that other embodiments of the apparatus 100 are possible, including a training apparatus that preferably comprise of three or four arms to allow more athletes to train simultaneously.

Figure 6:
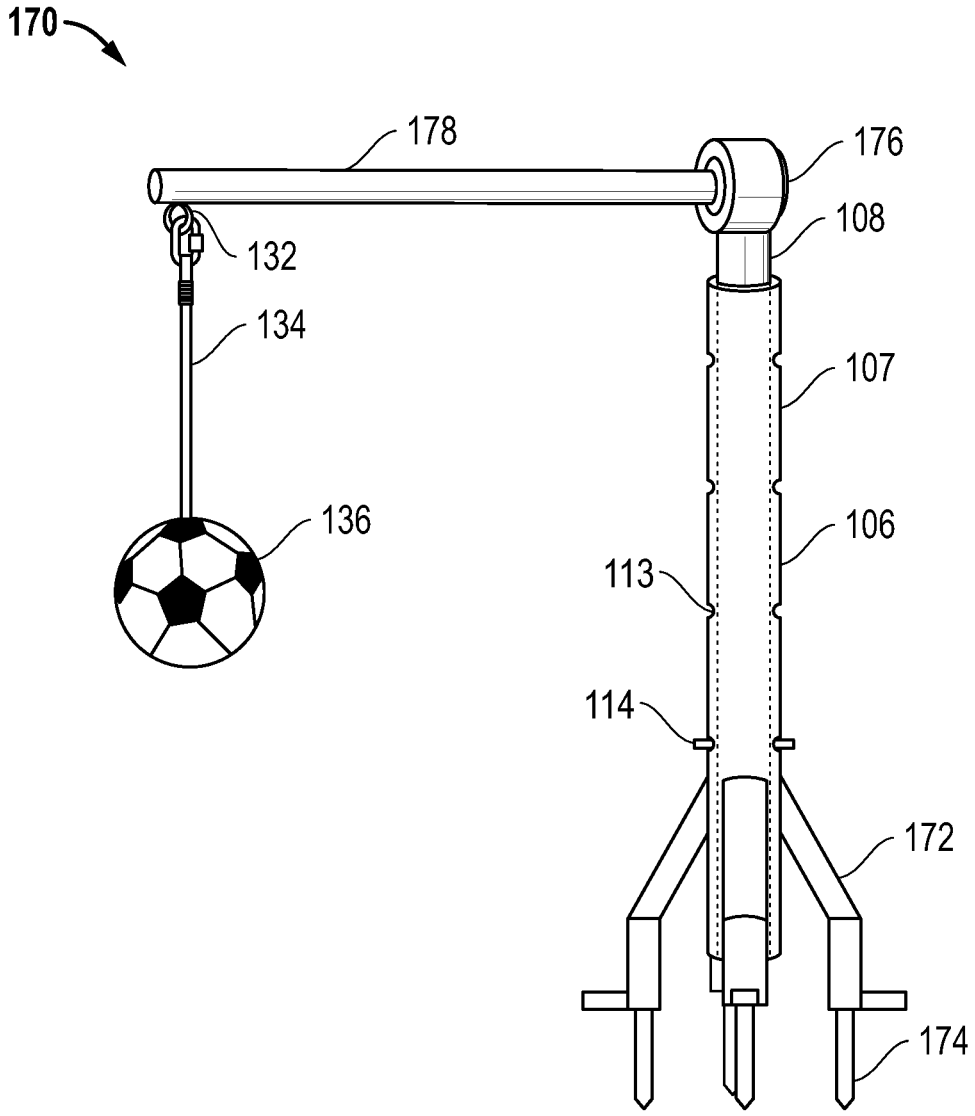
FIG. 6 is a frontal elevation view of the ball-striking training apparatus of FIG. 1, wherein the bearing assembly is mounted atop the stand.

Turning to FIG. 6, yet another embodiment of the invention is shown. In the embodiment shown in FIG. 6, an apparatus 170 is shown with several variances to the apparatus 100. The apparatus 170 similarly comprises a stand 106 with outer stand section 107 and inner stand section 108. The apparatus 170 is also height adjustable through the use of pin holes 113 and through-pins 114. However, rather than utilizing a base, the apparatus 170 is secured to a soil playing surface through the use of legs 172 that are preferably connected directly to the stand 106. As shown in embodiment 170, the four legs 172 are utilized to securely support the stand 106, however the invention additionally contemplates other embodiments where greater or fewer legs 172 may be used. A stake 174 may be attached at the lower end of each leg 172, with the stake 174 being generally similar in construction to stake 104. During use, the apparatus 170 is preferably secured into the ground by simply applying a downward pressure on the legs 172 such that the stakes 174 are driven into the ground.

A bearing assembly 176 is preferably connected on top of the stand 106 of the apparatus 170. The bearing assembly 176 is preferably similar in construction to the bearing assembly 120, save for the relative placement of the bearing assembly 176. An arm 178 extends from an inner race of the bearing assembly 176 to provide rotatable motion of the arm 178. Because the entire arm 178 of the apparatus 170 rotates during operation, the arm 178 is generally lighter and of a smaller diameter than the arm 112. A tether connector 132 is preferably located at end of the arm 178 opposite the bearing assembly 176, and is preferably used to attach a string 134. A ball 136 is tethered to an opposite end of the string 134. When struck or volleyed, the ball 136 may orbit around the arm 178, with the arm 178 rotating in relation to the bearing assembly 176. Thus, the apparatus 170 provides for functionality similar to the apparatus 100, with the primary differences being the different location of the bearing assembly 170 resulting in the rotation of arm 178 during use of the apparatus, as well as the use of the legs 172 and the stakes 174.

Figure 7:
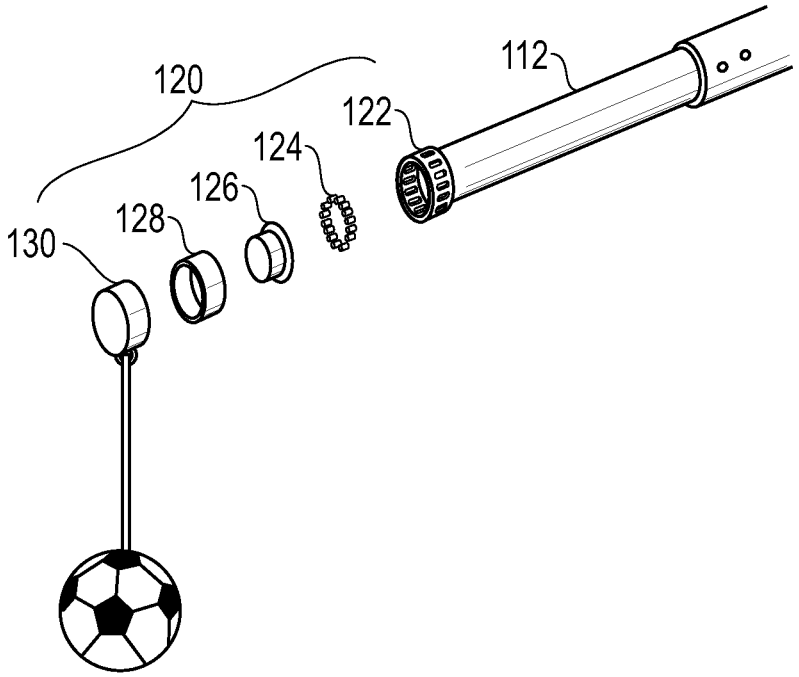
FIG. 7 provides an exploded view of the cylindrical/roller bearings used in the ball-striking training apparatus of FIG. 1.

Next, at FIG. 7, an exploded view of an exemplary embodiment of the bearing assembly 120 is shown. The bearing assembly 120 comprises a bearing cage 122, roller bearings 124, a circular inner ring or race 126, a circular outer ring or race 128, and a bearing cap 130. The bearing cage 122 has a series of equidistant slots disposed along the circumference of the bearing cage 122. The roller bearings 124 are fitted and locked within the slots of the bearing cage 122 to prevent the individual roller bearings 124 from shifting during rotation of the bearing assembly 120. The bearing cage 122 and the roller bearings 124 are fitted between the inner ring 126 and the outer ring 128 such that the inner surface of outer ring 128 and the outer surface of inner ring 126 maintains constant contact with the roller bearings 124. The inner ring 126, bearing cage 122, and the outer ring 128 are aligned together to form a roller bearing element, and are preferably shaped to utilize roller or cylinder bearings fitted within the slots of the bearing cage 122. The advantage of utilizing the roller bearings 124 in the bearing assembly 120 over conventional ball bearings as is known in the art is their greater ability to hold heavy radial loads. This is because the contact point between the bearing and the inner and outer ring is a line rather than a single point, as in a ball bearing. Thus, during operation of the bearing assembly 120, any centrifugal forces exerted upon the roller bearings 124 will be spread more evenly over a greater area, allowing the bearing assembly 120 to handle much greater loads than would be possible with conventional ball bearings.

The assembled roller bearing element comprising the bearing cage 122, roller bearings 124, inner ring 126 and outer ring 128 are connected to the end of arm 112 of apparatus 100. A bearing cap 130 is connected to the outer ring 128, thereby forming the complete bearing assembly 120. In operation, the outer ring 128 rotates relative to the inner ring 126, causing the bearing cap 130 and attached the tether connector 132 to rotate when the ball 136 is struck by an athlete.

During use of apparatus 100, an athlete may strike the ball 136 with a significant amount of force. If conventional ball bearings were utilized in the bearing assembly 120, the ball bearings would become deformed over time as a result of the substantial amount of force applied to the bearing assembly. This would eventually lead to the inner and outer rings falling out of alignment and failure of the bearing assembly. However, the present invention addresses this problem with the use of roller bearings, which have been found to be significantly better-able to withstand the centrifugal forces exerted upon the bearings as a result of an athlete's striking of the ball 136.

It will be readily apparent to those skilled in the art that the general principles defined herein may be applied to other embodiments and applications without departing from the spirit and scope of the present invention. Having thus described the exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is contemplated that the appended claims will cover any such modifications or embodiments that fall within the true scope of the invention.

What is claimed is:

1. An apparatus for practicing the striking of a ball, the apparatus comprising:

a base;

a stand removably attached to an end of the base;

a first arm having a first end removably connected to an end of the stand opposite the base;

a first rotating bearing assembly connected to a second end of the first arm, the bearing assembly comprising a bearing cage defining slots fitted with roller bearings, the bearing cage being fitted between an inner race and an outer race, the inner race being mounted to the second end of the first arm, the outer race being fitted within a bearing cap; and a first tethered ball interconnected to the bearing cap of the first rotating cylindrical bearing assembly with a first rope.

2. The apparatus of claim 1, further comprising an elbow having a first end removably connected to the stand and a second end removably connected to the first arm.

3. The apparatus of claim 1, the base defining a plurality of mounting holes along the perimeter of the base for mounting the base to a surface.

4. The apparatus of claim 1, the base having a stand mount centrally located in the base to receive a lower end of the stand.

5. The apparatus of claim 1, the base comprising a weighted assembly for use of the apparatus indoors.

6. The apparatus of claim 1, the base further comprising a plurality of legs for mounting the base to a surface.

7. The apparatus of claim 1, the stand comprising an inner stand section nested within an outer stand section.

8. The apparatus of claim 1, the stand comprising an inner stand section nested within an outer stand section, the inner stand section being configured to slide relative to the outer stand section.

9. The apparatus of claim 1, the apparatus further comprising:

a tee having a first end removably connected to the stand, the tee having a second end removably connected to the first end of the first arm;

a second arm having a first end removably connected to a third end of the tee;

a second rotating bearing assembly connected to a second end of the second arm; and a second tethered ball interconnected to the second rotating bearing assembly with a second rope.

10. The apparatus of claim 1, further comprising a plurality of through-pins for securing the stand and first arm, the pins inserted into a plurality of pin holes located on the side of the stand and first arm.

11. The apparatus of claim 1 wherein the first tethered ball is selected from the group consisting of a soccer ball, volleyball, and baseball.

12. A training apparatus comprising:

a base;

a stand removably attached to the base;

an elbow having a first end removably connected to the stand, the elbow having a first angle between the first end and a second end;

an arm having a first end removably connected to the second end of the elbow;

a bearing assembly connected to a second end of the arm, the bearing assembly being selected from the group consisting of a roller bearing, a cam follower bearing, a track roller wire straightener and guide bearing, a caged and center-guided roller bearing, a spherical roller bearing, and an aircraft bearing; and, a ball tethered to the cylindrical bearing assembly with a rope.

13. The apparatus of claim 12, the cylindrical bearing assembly further comprising a set of cylindrical bearings disposed between an inner race and an outer race of the bearing assembly.

14. The apparatus of claim 12, the rope comprising an elastic material.

15. The apparatus of claim 12, the stand comprising an inner stand section nested within an outer stand section, the inner stand section being configured to slide relative to the outer stand section.

16. The apparatus of claim 12, the first angle being substantially 90 degrees.

17. A training apparatus comprising:

a stand;

a plurality of downwardly affixed legs attached to a lower end of the stand;

a stake attached to a lower end of each of the legs;

a bearing assembly comprising a bearing cage defining slots fitted with roller bearings, the bearing cage being fitted between an inner race and an outer race, the outer race being mounted to an upper end of the stand, the bearing assembly having a rotatable arm extending from the inner race of the bearing assembly; and a ball tethered to an end of the arm opposite the bearing assembly with a rope.

18. The apparatus of claim 17, the bearing assembly further comprising cylindrical bearings.

19. The apparatus of claim 17, the stand comprising an inner stand section nested within an outer stand section, the inner stand section being configured to slide relative to the outer stand section.

20. The apparatus of claim 17, wherein each stake is securely attached to the lower end of each of the legs such that the apparatus may be secured into the ground by the application of a downward pressure on one or more of the legs such that each stake is driven into the ground.

* * * * *